US008073665B2

(12) United States Patent
Watters et al.

(10) Patent No.: US 8,073,665 B2
(45) Date of Patent: Dec. 6, 2011

(54) ANALYZING AN OILFIELD NETWORK FOR OILFIELD PRODUCTION

(75) Inventors: Colin Watters, Reading (GB); Adrian Ferramosca, Harwell (GB); James Bennett, Abingdon (GB); Daniel Lucas-Clements, Faringdon (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 402 days.

(21) Appl. No.: 12/388,718

(22) Filed: Feb. 19, 2009

(65) Prior Publication Data

US 2010/0049490 A1 Feb. 25, 2010

Related U.S. Application Data

(60) Provisional application No. 61/034,893, filed on Mar. 7, 2008.

(51) Int. Cl.

| | |
|---|---|
| ***G06G 7/48*** | (2006.01) |
| ***G01V 1/40*** | (2006.01) |
| ***G01V 3/18*** | (2006.01) |
| ***G01V 5/04*** | (2006.01) |
| ***G01V 9/00*** | (2006.01) |
| ***G01V 3/00*** | (2006.01) |

(52) U.S. Cl. ..... 703/10; 703/6; 702/6; 702/13; 340/853.1; 340/853.3

(58) Field of Classification Search ..... 703/10, 703/6; 340/853.1–856.1, 853; 702/6–13
See application file for complete search history.

(56) References Cited

U.S. PATENT DOCUMENTS

| | | | | |
|---|---|---|---|---|
| 5,540,087 | A * | 7/1996 | Bickert et al. | 73/53.05 |
| 5,992,519 | A | 11/1999 | Ramakrishnan et al. | |
| 6,236,894 | B1 | 5/2001 | Stoisits | |
| 6,313,837 | B1 | 11/2001 | Assa et al. | |
| 6,426,917 | B1 * | 7/2002 | Tabanou et al. | 367/82 |
| 6,519,568 | B1 | 2/2003 | Harvey et al. | |

(Continued)

FOREIGN PATENT DOCUMENTS

WO 9964896 12/1999

(Continued)

OTHER PUBLICATIONS

Moitra, S.K. et al., "A Field-Wide Integrated Production Model and Asset Management System for the Mumbai High Field", Apr. 30-May 3, 2007, 2007 Offshore Technology Conference.*

(Continued)

*Primary Examiner* — Paul Rodriguez
*Assistant Examiner* — Cedric D Johnson

(57) ABSTRACT

A method for analyzing an oilfield network. The method includes collecting oilfield data from an oilfield network, modeling a first wellsite and a second wellsite using the oilfield data to create a first production model of the first wellsite and a second production model of the second wellsite. The method further includes modeling a sub-network of the oilfield network to create a third production model of the sub-network. The modeling of the sub-network includes identifying a junction of branches associated with the first wellsite and the second wellsite. A fourth production model is created for the junction by combining the first production model with the second production model. The production model of the sub-network is created using the fourth production model of the junction. The method further includes solving the oilfield network based on the third production model to create a production result, and storing the production result.

20 Claims, 12 Drawing Sheets

U.S. PATENT DOCUMENTS

| | | | | |
|---|---|---|---|---|
| 6,980,940 | B1 | 12/2005 | Gurpinar et al. | |
| 2003/0132934 | A1 | 7/2003 | Fremming | |
| 2003/0216897 | A1 | 11/2003 | Endres et al. | |
| 2004/0220846 | A1 | 11/2004 | Cullick et al. | |
| 2005/0149307 | A1 | 7/2005 | Gurpinar et al. | |
| 2006/0036418 | A1 | 2/2006 | Pita | |
| 2006/0197759 | A1 | 9/2006 | Fremming | |
| 2007/0061087 | A1* | 3/2007 | Ghorayeb et al. | 702/30 |
| 2007/0073527 | A1 | 3/2007 | Flandrin | |
| 2007/0112547 | A1 | 5/2007 | Ghorayeb et al. | |
| 2007/0183260 | A1* | 8/2007 | Lee et al. | 367/25 |
| 2007/0199721 | A1* | 8/2007 | Givens et al. | 166/382 |
| 2007/0299643 | A1* | 12/2007 | Guyaguler et al. | 703/10 |

FOREIGN PATENT DOCUMENTS

| | | |
|---|---|---|
| WO | 2004049216 | 6/2004 |
| WO | WO 2004049216 A1 * | 6/2004 |
| WO | 2005122001 | 12/2005 |

OTHER PUBLICATIONS

Petroleum Experts, "IPM Engineering Software Development", 2004, Petroleum Experts Ltd.*
Merrick Systems White Paper, "Engineering Workflows in Upstream Production Surveillance and Real Time Optimization", May 2007.*
Zabalza-Mezghani, Isabelle et al., "Uncertainty Management: From Geological Scenarios to Production Scheme Optimization", 2004, Elsevier B.V.*
Nor-Azlan, N. et al., "Development of Asphaltene Phase Equilibria Predictive Model", Nov. 2-4, 1993, 1993 Eastern Regional Conference and Exibition, Society of Petroleum Engineers, Inc.*
Schlumberger, "Conventional Pilot-Operated Valves", www.slb.com/oilfield, Jul. 2003, (2 Pages).
Schlumberger, "Conventional Injection-Pressure-Operated Valves", www.c1b.com/oilfield, Jul. 2003, (2 Pages).
Schlumberger, "C-Series Conventional Mandrels", www.slb.com/oilfield, Jul. 2003, (2 Pages).
Schlumberger, "B-Series Conventional Mandrels", www.slb.com/oilfield, Jul. 2003, (2 Pages).
Schlumberger, "Conventional Reverse-Flow Check Valves", www.slb.com/oilfield, Jul. 2003, (2 Pages).
Schlumberger, "Conventional Production-Pressure-Operated Valves", www.slb.com/oilfield, Jul. 2003, (2 Pages).
Schlumberger, "PIPESIM: Pipeline and facilities design and analysis", www.sis.slb.com, Jan. 2003, (4 Pages).
Schlumberger, "PIPESIM: Well design and production performance analysis", www.sis.slb.com, Jan. 2003, (4 Pages).
Schlumberger, "Flow Assurance Modeling", www.slb.com/oilfield, May 2003, (1 Page).
Schlumberger, "PIPESIM: Well and Pipeline Simulation", www.slb.com/sis, Apr. 2006, (2 Pages).
Schlumberger, "Conventional Waterflood Flow Regulator Valves", www.slb.com/oilfield, Jul. 2003, (2 Pages).

* cited by examiner

FIG.6
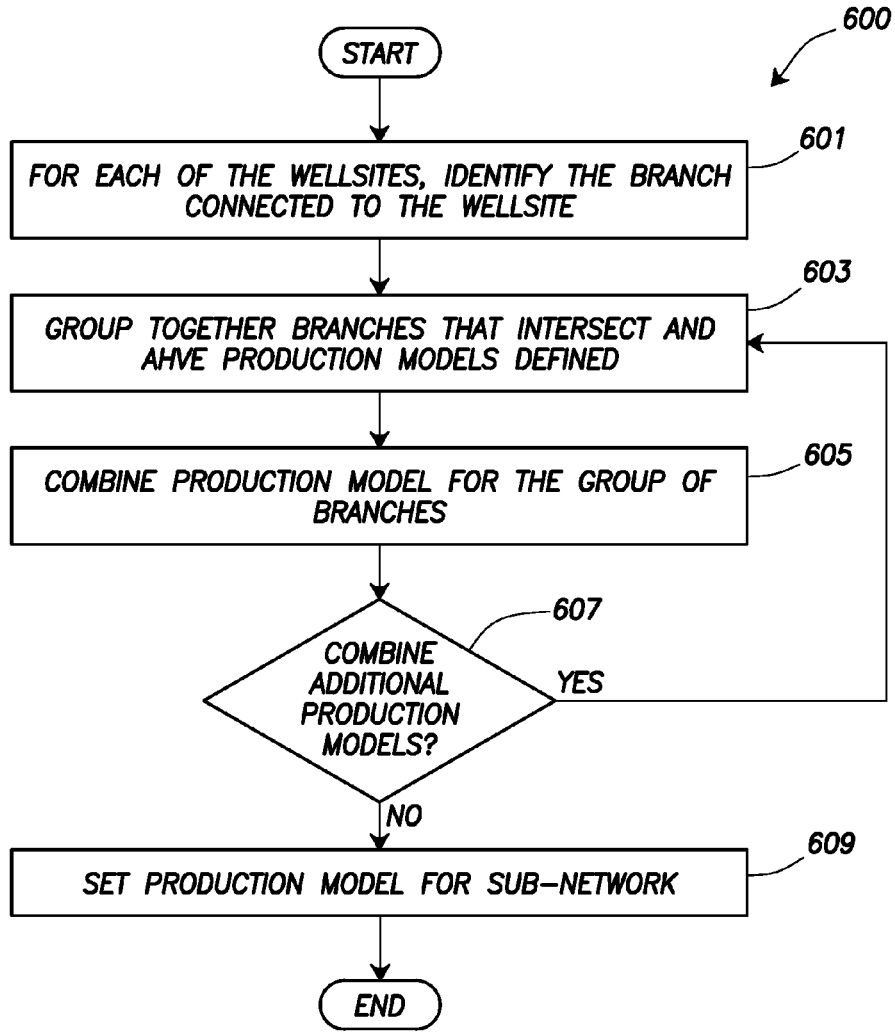
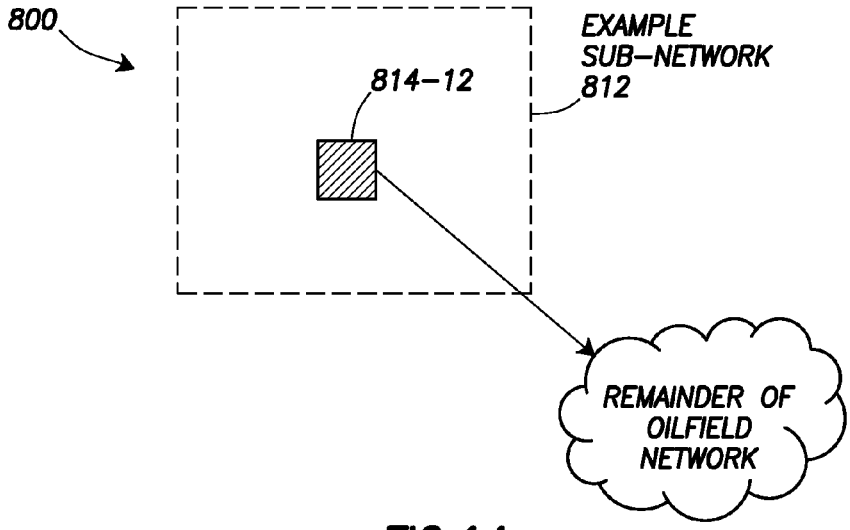
FIG.14

ANALYZING AN OILFIELD NETWORK FOR OILFIELD PRODUCTION

CROSS REFERENCE TO RELATED APPLICATION

This application claims priority, pursuant to 35 U.S.C. §119(e), to the filing date of U.S. Provisional Patent Application Ser. No. 61/034,893, entitled "System and Method for Performing Oilfield Production Operations," filed on Mar. 7, 2008, which is hereby incorporated by reference in its entirety

BACKGROUND

A typical oilfield includes a collection of wellsites. Hydrocarbons flow from the collection of wellsites through a series of pipes to a processing facility. The series of pipes are often interconnected, thereby forming an oilfield network. For example, one wellsite may connect to a series of pipes that connect to another wellsite. The interconnection provides a redundancy in the paths in which hydrocarbons may flow while minimizing the number of pipes needed.

Oilfield operations, such as surveying, drilling, wireline testing, completions, production, planning and oilfield analysis, are typically performed to locate and gather valuable downhole fluids. Specifically, the oilfield operations assist in the production of hydrocarbons. One such oilfield operation is the analysis of the oilfield network.

SUMMARY

In general, in one aspect, embodiments of analyzing an oilfield network for oilfield production include a method for performing the analysis. The oilfield network includes multiple wellsites. The method includes collecting oilfield data from the oilfield network, modeling a first wellsite using the oilfield data to create a first production model of the first wellsite, and modeling a second wellsite using the oilfield data to create a second production model of the second wellsite. The method further includes modeling a sub-network of the oilfield network to create a third production model of the sub-network. The modeling of the sub-network includes identifying a junction of a branch associated with the first wellsite and a branch associated with the second wellsite. A fourth production model is created for the junction by combining the first production model with the second production model. The production model of the sub-network is created using the fourth production model of the junction. The method further includes solving the oilfield network based on the third production model to create a production result, and storing the production result.

BRIEF DESCRIPTION OF DRAWINGS

FIGS. 4-6 show example flowcharts depicting production methods for analyzing an oilfield network for oilfield production.

FIGS. 11-14 show examples of production methods for analyzing an oilfield network for oilfield production.

DETAILED DESCRIPTION

Figure 1:
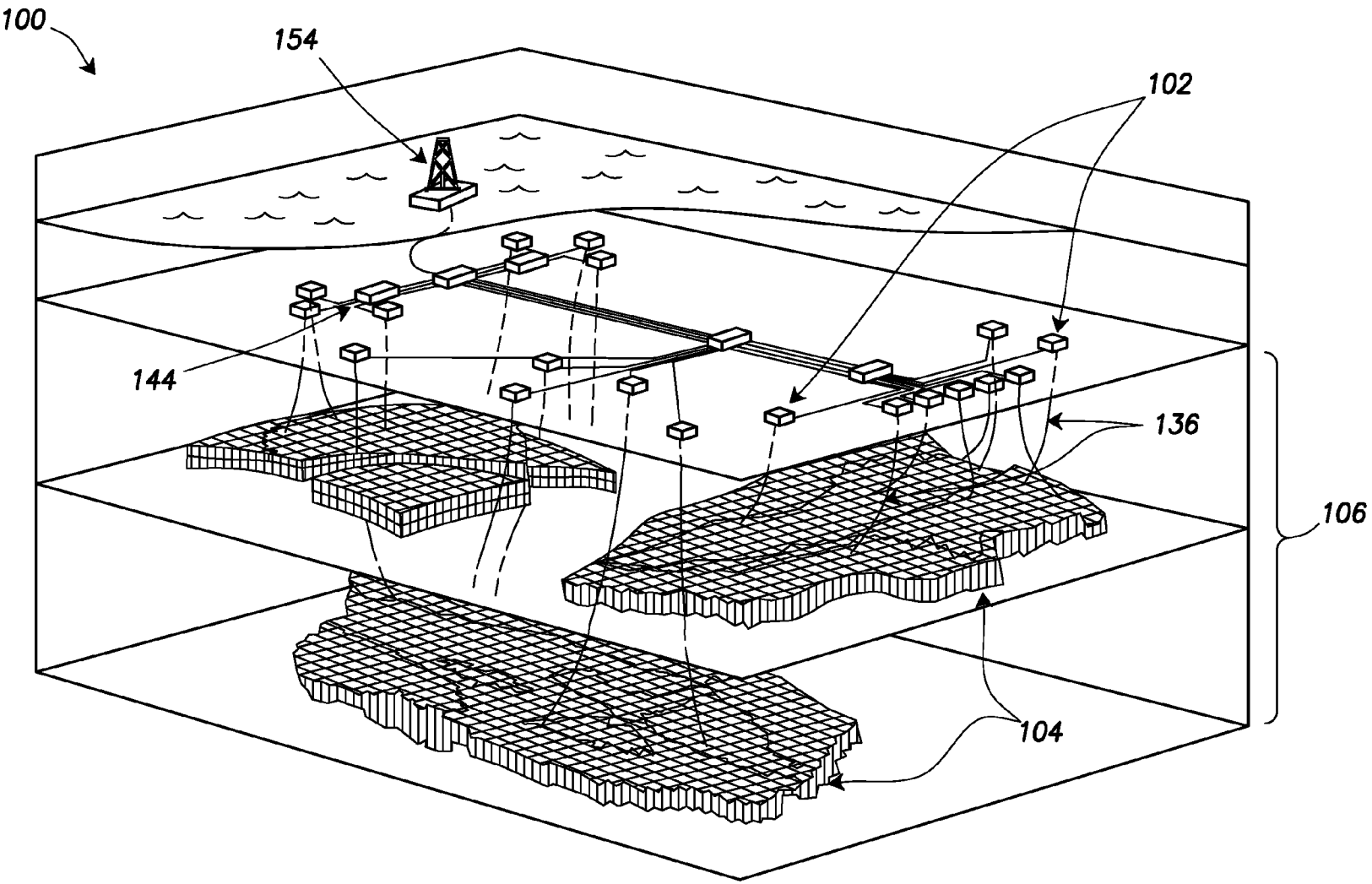
FIG. 1 shows an example schematic view of an oilfield having a plurality of wellsites for producing oil from the subterranean formation.

Presently embodiments are shown in the above-identified FIGS. and described in detail below. In describing the embodiments, like or identical reference numerals are used to identify common or similar elements. The figures are not necessarily to scale and certain features and certain views of the figures may be shown exaggerated in scale or in schematic in the interest of clarity and conciseness.

In the following detailed description of embodiments of analyzing a network for oilfield production, numerous specific details are set forth in order to provide a more thorough understanding. However, it will be apparent to one of ordinary skill in the art that analyzing the network for oilfield production may be practiced without these specific details. In other instances, well-known features have not been described in detail to avoid unnecessarily complicating the description.

FIG. 1 illustrates an oilfield (100) for performing production operations. As shown, the oilfield has a plurality of wellsites (102) operatively connected to a central processing facility (154). The oilfield configuration of FIG. 1 is not intended to limit the scope. Part or all of the oilfield may be on land and/or sea. Also, while a single oilfield with a single processing facility and a plurality of wellsites is depicted, any combination of one or more oilfields, one or more processing facilities, and one or more wellsites may be present.

Each wellsite (102) has equipment that forms a wellbore (136) into the earth. The wellbores extend through subterranean formations (106) including reservoirs (104). These reservoirs (104) include fluids, such as hydrocarbons. The wellsites draw fluid from the reservoirs and pass them to the processing facilities via oilfield networks (144). The oilfield networks (144) have tubing and control mechanisms for controlling the flow of fluid and/or gas from the wellsite to the processing facility (154).

Figure 2:
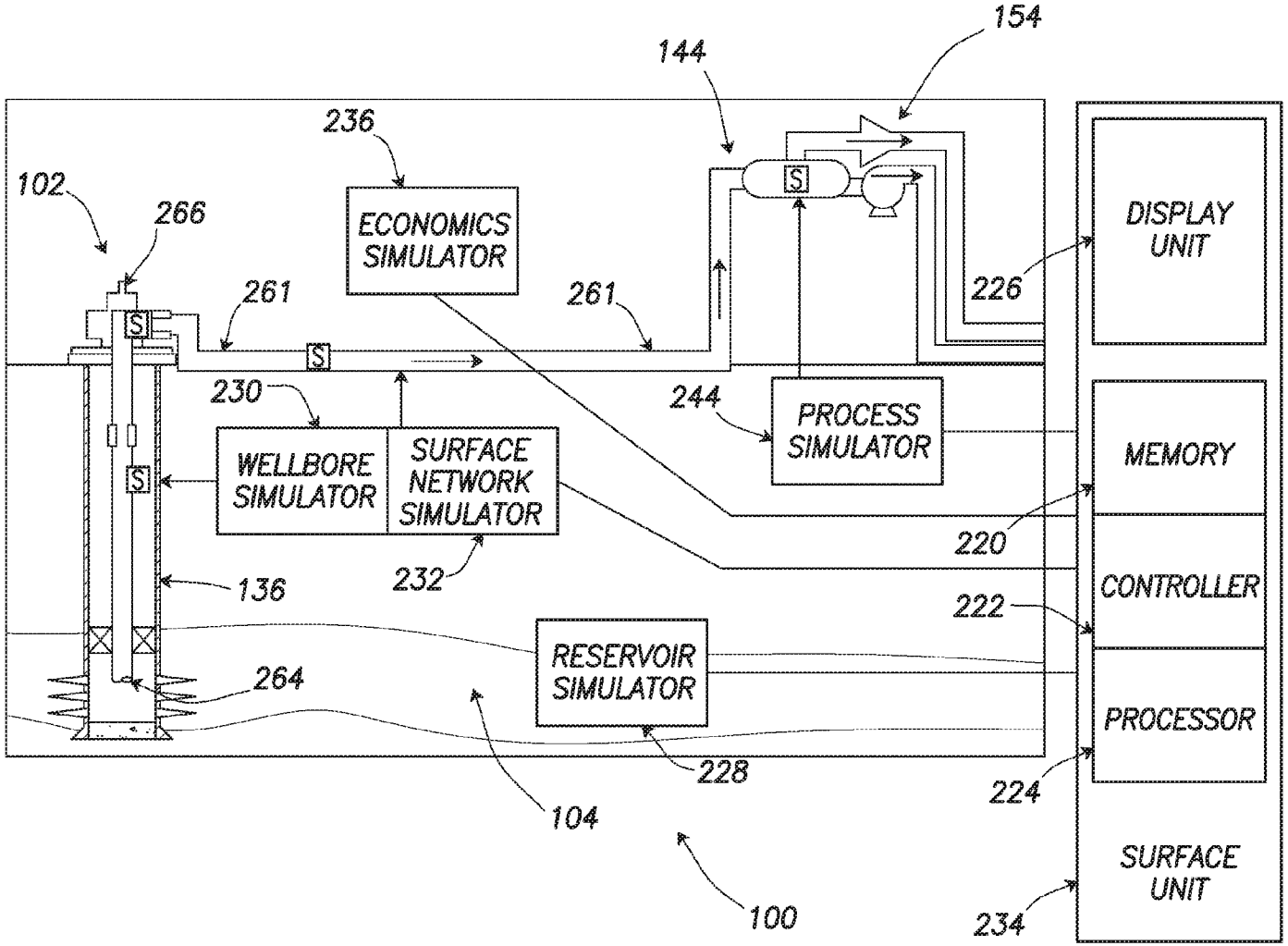
FIG. 2 shows an example schematic diagram of a portion of the oilfield of FIG. 1 depicting the production operation in greater detail.

FIG. 2 shows a schematic view of a portion of the oilfield (100) of FIG. 1, depicting a wellsite (102) and oilfield network (144) in detail. The wellsite (102) of FIG. 2 has a wellbore (136) extending into the earth therebelow. As shown, the wellbore (136) has already been drilled, completed, and prepared for production from reservoir (104).

Wellbore production equipment (264) extends from a wellhead (266) of wellsite (102) and to the reservoir (104) to draw fluid to the surface. The wellsite (102) is operatively connected to the oilfield network (144) via a transport line (261). Fluid flows from the reservoir (104), through the wellbore (136), and onto the oilfield network (144). The fluid then flows from the oilfield network (144) to one or more processing facilities (154).

As further shown in FIG. 2, sensors (S) are located about the oiufield (100) to monitor various parameters during oilfield operations. The sensors (S) may measure, for example, pressure, temperature, flowrate, composition, and other parameters of the reservoir, wellbore, gathering network, process facilities and/or other portions of the oilfield operation. These sensors (S) are operatively connected to a surface unit (234) for collecting data therefrom.

As shown in FIG. 2, the surface unit (234) has computer facilities, such as memory (220), controller (222), processor (224), and display unit (226), for managing the data. The data is collected in memory (220), and processed by the processor (224) for analysis. Data may be collected from the oilfield sensors (S) and/or by other sources. For example, oilfield data may be supplemented by historical data collected from other operations, or user inputs.

The analyzed data may then be used to make decisions. A transceiver (not shown) may be provided to allow communications between the surface unit (234) and the oilfield (100). The controller (222) may be used to actuate mechanisms at the oilfield (100) via the transceiver and based on these decisions. In this manner, the oilfield (100) may be selectively adjusted based on the data collected. These adjustments may be made automatically based on computer protocol and/or manually by an operator. In some cases, well plans are adjusted to select optimum operating conditions or to avoid problems.

A display unit (226) may be provided at the wellsite (102) and/or remote locations for viewing oilfield data (not shown). The oilfield data represented by a display unit (226) may be raw data, processed data and/or data outputs generated from various data. The display unit (226) is preferably adapted to provide flexible views of the data, so that the screens depicted may be customized as desired. A user may determine the desired course of action during production based on reviewing the displayed oilfield data. The production operation may be selectively adjusted in response to the display unit (226). The display unit (226) may include a two-dimensional display for viewing oilfield data or defining oilfield events. For example, the two-dimensional display may correspond to an output from a printer, plot, a monitor, or another device configured to render two-dimensional output. The display unit (226) may also include a three-dimensional display for viewing various aspects of the production operation. At least some aspect of the production operation is preferably viewed in real time in the three-dimensional display. For example, the three-dimensional display may correspond to an output from a printer, plot, a monitor, or another device configured to render three-dimensional output.

To facilitate the processing and analysis of data, simulators may be used to process the data. Specific simulators are often used in connection with specific oilfield operations, such as reservoir or wellbore production. Data fed into the simulator(s) may be historical data, real time data or combinations thereof. Simulation through one or more of the simulators may be repeated or adjusted based on the data received.

As shown, the oilfield operation is provided with wellsite and non-wellsite simulators. The wellsite simulators may include a reservoir simulator (228), a wellbore simulator (230), and a surface network simulator (232). The reservoir simulator (228) solves for hydrocarbon flowrate through the reservoir and into the wellbores. The wellbore simulator (230) and surface network simulator (232) solves for hydrocarbon flowrate through the wellbore and the surface gathering network (144) of pipelines. As shown, some of the simulators may be separate or combined, depending on the available systems.

The non-wellsite simulators may include process and economics simulators. The processing unit has a process simulator (244). The process simulator (244) models the processing plant (e.g., the process facility (154)) where the hydrocarbon is separated into its constituent components (e.g., methane, ethane, propane, etc.) and prepared for sales. The oilfield (100) is provided with an economics simulator (236). The economics simulator (236) models the costs of part or all of the oilfield. Various combinations of these and other oilfield simulators may be provided.

Figure 3:
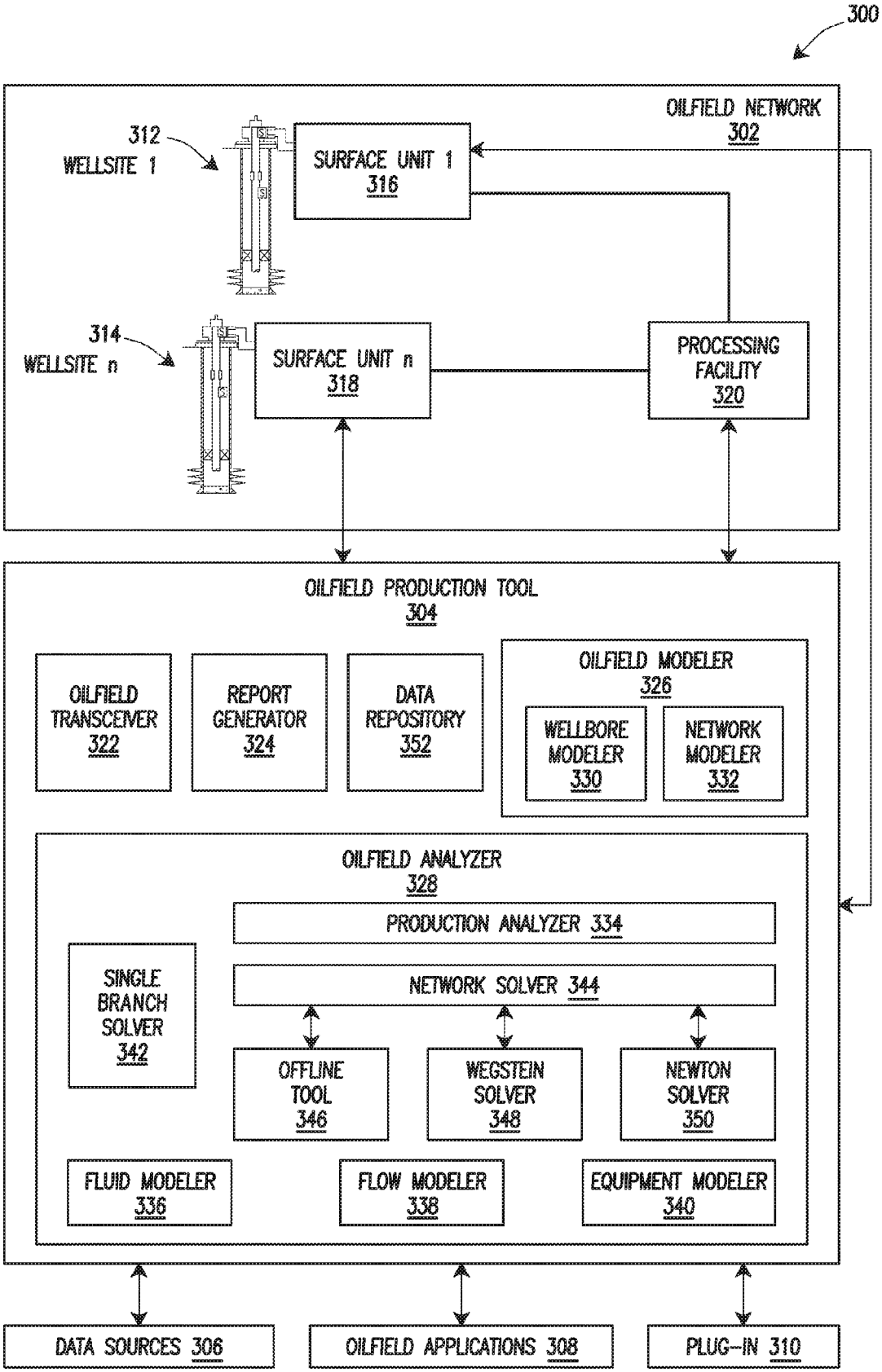
FIG. 3 shows an example schematic diagram of a production system for analyzing an oilfield network for oilfield production.

FIG. 3 shows an example schematic diagram of production system (300) for performing oilfield production operations. As shown in FIG. 3, the production system (300) includes an oilfield network (302), an oilfield production tool (304), data sources (306), oilfield application(s) (308), and plug-in(s) (310). As discussed above, an oilfield network (302) is an interconnection of pipes that connects wellsites (e.g., wellsite 1 (312), wellsite n (314)) to a processing facility (320). The pipes may be virtually any type of tubing known in the art. A pipe in the oilfield network (302) may be connected to a processing facility (e.g., processing facility (320)), a wellsite (e.g., wellsite 1 (312), wellsite n (314)), and/or a junction in which pipes are connected. Additionally, the flowrate of fluid and/or gas into the pipes may be adjustable. Thus, certain pipes in the oilfield network may be closed so as to not allow fluid and/or gas through the pipe. A pipe may be considered open when the pipe allows for flow of fluid and/or gas.

The oilfield network (302) may be a gathering network and/or an injection network. A gathering network is an oilfield network used to obtain hydrocarbons from a wellsite (e.g., wellsite 1 (312), wellsite n (314)). In a gathering network, hydrocarbons may flow from the wellsites (e.g., wellsite 1 (312), wellsite n (314)) to the processing facility (320). An injection network is an oilfield network used to inject the wellsites with injection substances, such as water, carbon dioxide, and other chemicals that may be injected into the wellsites (e.g., wellsite 1 (312), wellsite n (314)). In an injection network, the flow of the injection substance may flow towards the wellsite (e.g., wellsite 1 (312), wellsite n (314)).

The oilfield network (302) may also include surface units (e.g., surface unit 1 (316), surface unit n (318)) for each wellsite (e.g., wellsite 1 (312), wellsite n (314)). The surface units (e.g., surface unit 1 (316), surface unit n (318)) may include functionality to collect data from sensors (not shown). The sensors may include sensors for measuring flowrate, water cut, gas lift rate, pressure, and/or other such variables related to measuring and monitoring hydrocarbon production.

Continuing with FIG. 3, an oilfield production tool (304) may be connected to the oilfield network (302). The oilfield production tool (304) may be a simulator or a plug-in for a simulator (or other application). The oilfield production tool (304) may include an oilfield transceiver (322), a report generator (324), an oilfield modeler (326), and an oilfield analyzer (328). Each of these components is described below.

An oilfield transceiver (322) includes functionality to collect oilfield data. The oilfield data may be data from sensors (discussed above), historical data, or any other such data. The oilfield transceiver (322) may also include functionality to interact with a user and display data such as a production result.

The report generator (324) includes functionality to produce graphical and textual reports. The reports may show historical oilfield data, production models, production results, sensor data, aggregated oilfield data, or any other such type of data.

The data repository (352) is any type of storage unit and/or device (e.g., a file system, database, collection of tables, or any other storage mechanism) for storing data, such as the production results, sensor data, aggregated oilfield data, or any other such type of data. Further, the data repository (352) may include multiple different storage units and/or hardware devices. The multiple different storage units and/or devices may or may not be of the same type or located at the same physical site. In one or more embodiments, the data repository (352), or a portion thereof, is secure.

The oilfield modeler (326) includes functionality to create a model of the wellbore and the oilfield network. The oilfield modeler (326) includes a wellbore modeler (330) and a network modeler (332). The wellbore modeler (330) allows a user to create a graphical wellbore model or single branch model. The wellbore model defines the operating parameters (actual or theoretical) of the wellbore (e.g., pressure, flowrate, etc). The single branch model defines the operating parameters (actual or theoretical) of a single branch in the oilfield network. The network modeler (332) allows a user to create a graphical network model that combines wellbore models and/or single branch models. The network modeler (332) and/or wellbore modeler (330) may model pipes in the oilfield network (302) as branches (not shown) of the oilfield network (302). Each branch may be connected to a wellsite or a junction. A junction is a group of two or more pipes that intersect at a particular location. The modeled oilfield network may be divided into sub-networks. A sub-network is a portion of the oilfield network (302). A sub-network is connected to the oilfield network (302) using at least one branch. Sub-networks may be a group of connected wellsites, branches, and junctions. The sub-networks may be disjoint. Specifically, branches and wellsites in one sub-network may not exist in another sub-network.

An oilfield analyzer (328) includes functionality to analyze the oilfield network (302) and generate a production result for the oilfield network (302). The oilfield analyzer (328) may include one or more of the following: a production analyzer (334), a fluid modeler (336), a flow modeler (338), an equipment modeler (340), a single branch solver (342), a network solver (344), a Wegstein solver (348), a Newton solver (350), and an Offline tool (346). The components of the oilfield analyzer are discussed below.

A production analyzer (334) includes functionality to receive a workflow request and interact with the single branch solver (342) and/or the network solver (344) based on the workflow. For example, the workflow may include a nodal analysis to analyze a wellsite or junction of branches, pressure and temperature profile, model calibration, gas lift design, gas lift optimization, network analysis, and other such workflows.

The fluid modeler (336) includes functionality to calculate fluid properties (e.g., phases present, densities and viscosities) using compositional and/or black oil fluid models. The fluid modeler (336) may include functionality to model oil, gas, water, hydrate, wax, and asphaltene phases. The flow modeler (338) includes functionality to calculate pressure drop in pipes and tubing using industry standard multiphase flow correlations. The equipment modeler (340) includes functionality to calculate pressure changes in equipment pieces (e.g., chokes, pumps, compressors).

The single branch solver (342) may include functionality to calculate the flow and pressure drop in a wellbore or a single flowline branch given various inputs.

The network solver (344) includes functionality calculate a flowrate and pressure drop throughout the oilfield network (302). The network solver is connected to an offline tool (346), a Wegstein solver (348), and a Newton solver (350).

The offline tool (346) may include a wells offline tool (not shown) and a branches offline tool (not shown). The wells offline tool includes functionality to generate a production model using the single branch solver (342) for a wellsite or branch. A branches offline tool includes functionality to generate a production model for a sub-network using the production model for a wellsite, a single branch, or a sub-network of the sub-network.

A production model is a description of the wellsite at various operational conditions. In particular, the production model may include one or more production functions which combined create the production model. Each production function may be a function of variables related to the production of hydrocarbons. For example, the production function may be a function of flowrate and/or pressure. Further, the production function may account for environmental conditions related to the sub-network of the oilfield network (302), such as changes in elevation, diameters of pipes, combination of pipes, and changes in pressure resulting from joining pipes. The production model estimates the flowrate for a wellsite or sub-network of the oilfield network.

Additionally, separate production functions may exist for changes in values of an operational condition. The operational condition identifies a property of the hydrocarbons or injection substance. For example, the operational condition may include a watercut, reservoir pressure, gas lift rate, etc. One skilled in the art will appreciate that other operational conditions, variables, environmental conditions may be considered without departing from the scope.

Continuing with FIG. 3, the network solver (344) is connected to a Wegstein solver (348) and/or a Newton solver (350). The Wegstein solver (348) and the Newton solver (350) include functionality to combine the production model for several sub-networks to create a production result that may be used to plan the oilfield network, optimize the flowrates of the wellsites in the oilfield network, and/or identify and correct faulty components within the oilfield network.

The Wegstein solver (348) uses an iterative method with Wegstein acceleration (discussed below). The following paragraphs describe an example of the Wegstein solver. One skilled in the art will appreciate that the following is an example only and not intended to limit the scope. An oilfield network may be solved by identifying the pressure drop from the following equation:

$$P1 - P2 = \Delta pf + \Delta pe + \Delta ps \qquad \text{[Equation 1]}$$
$$= Q * Rf + (P1 + P2) * \mathrm{Re} + \Delta ps$$

The equation may be rearranged to solve for flowrate as shown in the following equation:

$$Q=(1-Re)/Rf*P1+(-1-Re)/Rf*P2-\Delta ps/Rf \qquad \text{[Equation 2]}$$

Applying Equation 2 for each flow into and out of a node and equating to zero, a linear matrix in the unknown pressures is obtained. Fixed flow branches (i.e., branches in which the flow does not change) may be solved directly for the node pressures.

Thus, in the example, the Wegstein Solver (348) may perform the following: (1) obtain initial estimates for the frictional and elevational resistances from the production models; (2) solve the linear system using Equation 2 above for the unknown node pressures; (3) calculate resulting flowrates using Equation 2; (4) calculate pressure residuals at each internal node; and (5) determine whether the maximum of the pressure residuals is lower than the required tolerance. If the maximum pressure residual is not lower than the required tolerance then the Wegstein solver may continue by rerun all the branches, with the pressure and flows calculated in steps 2 and 3 above to re-estimate the branch resistances. Further, Wegstein acceleration may be applied to the resistances before returning to step 2 (above).

The Wegstein acceleration is a weighted average of the guess and result as shown by the following equation: $Rnew=(1-\lambda)*Rin+\lambda*Rcalc$. In the above equation, $\lambda=1$ results in repeated substitution, while $\lambda=0$ is a fully damped solution which will never move from the initial guess.

Once the maximum of the pressure residuals is determined to be lower than the required tolerance, the Wegstein method may stop processing and the final result is the production result.

The Newton solver (344) implements the Newton method for solving a system of non-linear equations. The following is an example of a Newton method. One skilled in the art will appreciate that the following is an example only and not intended to limit the scope. The Newton method is an iterative method for solving a system of non-linear equations defined by:

$$R(X)=0 \quad \text{[Equation 3]}$$

In the above equation, $X=(X_1, \ldots X_n)$. X is a vector of n unknown variables, and $R=(R_1, \ldots R_n)$ is a vector of n residual equations. The solution is found by starting with an initial guess $X_0$ and iterating using the following equation:

$$X^{k+1}=X^k+\lambda^k \cdot \Delta X^k \quad k=0, 1, \ldots \quad \text{[Equation 4]}$$

The iteration stops when a convergence criterion is met. For example, when a norm of the residuals is less than a user-defined tolerance as denoted in the following equation:

$$\|R(X^k)\|<\epsilon \quad \text{[Equation 5]}$$

The Newton update $\Delta X_k$ in Equation 4 is found by solving a matrix equation. The matrix equation uses a Jacobian matrix and is denoted below:

$$J(X^k)\cdot\Delta X^k=-R(X^k) \quad \text{[Equation 6]}$$

The Jacobian matrix is formed by differentiating the residual equations with respect to the variables R and X as shown by the following matrix:

$$J=\begin{pmatrix} \frac{\partial R_1}{\partial X_1} & \cdots & \frac{\partial R_1}{\partial X_n} \\ \cdots & \cdots & \cdots \\ \frac{\partial R_n}{\partial X_1} & \cdots & \frac{\partial R_n}{\partial X_n} \end{pmatrix} \quad \text{[Equation 7]}$$

The factor $\lambda^k$ in Equation 4 is an adjustment to the pure Newton update, to allow special circumstances to be taken into consideration.

Thus, the Newton solver (344) includes functionality to solve the oilfield network (302) by implementing the Newton method (discussed above). Below is an example of how the Newton solver may be used to solve oilfield network (302).

Steps in applying the Newton method to solving an oilfield network may include: (1) defining variables and residual equations, X, R; (2) determine initial solution $X_0$; (3) calculating Residual and Jacobian matrix for each iteration; (4) solve Jacobian equation (i.e., Equation 6) for the Newton update; (5) determining adjustment factor $\lambda^k$; and (6) updating the solution (i.e., using Equation 4. Below is a description of the above steps.

With regards to the first step, defining variables and residual equations, X, R, branches in an oilfield network may include may contain a number of equipment items. Each branch is may be divided into sub-branches with each sub-branch containing a single equipment item. A new node may be used to join each pair of sub-branches. The primary Newton variables X consist of a flow ("$Q_{ib}$") in each sub-branch in the network and a pressure $P_{in}$ at each node in the network. Temperature (or enthalpy) and composition may be treated as secondary variables.

The residual equations may include a branch residual, an internal node residual, and a boundary condition. A branch residual for a sub-branch relates the branch flow to the pressure at the branch inlet node and the pressure at the outlet node. The internal node residuals define where the total flow into a node is equal to the total flow out of the node.

Determining an initial solution may be performed using the production models described above. During each iteration after the initial solution, a residual and Jacobian matrix for each iteration is calculated. The Jacobian matrix may be used to solve Jacobian equation (i.e., Equation 6 above) for the Newton update. In order to solve the Jacobian equation, standard matrix solvers may be used. Further, the adjustment factor (i.e., "$\lambda^k$") is identified and used to update the solution in Equation 4.

Those skilled the art will appreciate that the network solver may use other equations and/or solvers.

Continuing with FIG. 3, data sources (306) include any repository of data. For example, the data sources (306) may be internet sources, sources from the company having the oilfield network (302), or any other location in which data may be obtained. The data may include historical data, data collected from other oilfield networks, data collected from the oilfield network being modeled, data describing environmental or operational conditions.

Oilfield applications (308) are applications related to the production of hydrocarbons. The oilfield applications (308) may include functionality to evaluate a formation, manage drilling operations, evaluate seismic data, evaluate workflows in the oilfield, perform simulations, or perform any other oilfield related function. The plug-ins (310) allows integration with $3^{rd}$ party packages such as Tulsa University flow model, Scandpower's Olga flow model, Infochem's Multiflash fluid model package, equipment models and other such $3^{rd}$ party packages.

While FIG. 3 shows the oilfield production tool (304) as a separate component from the oilfield network (302), the oilfield production tool (304) may alternatively be part of the oilfield network (302). For example, the oilfield production tool (304) may be located at one of the wellsites (e.g., wellsite 1 (312), wellsite n (314)), at the processing facility (320), or any other location in the oilfield network (302). In another alternative, the oilfield production tool (304) may exist separate from the oilfield network (302), such as when the oilfield production tool (304) is used to plan the oilfield network.

Figure 5:
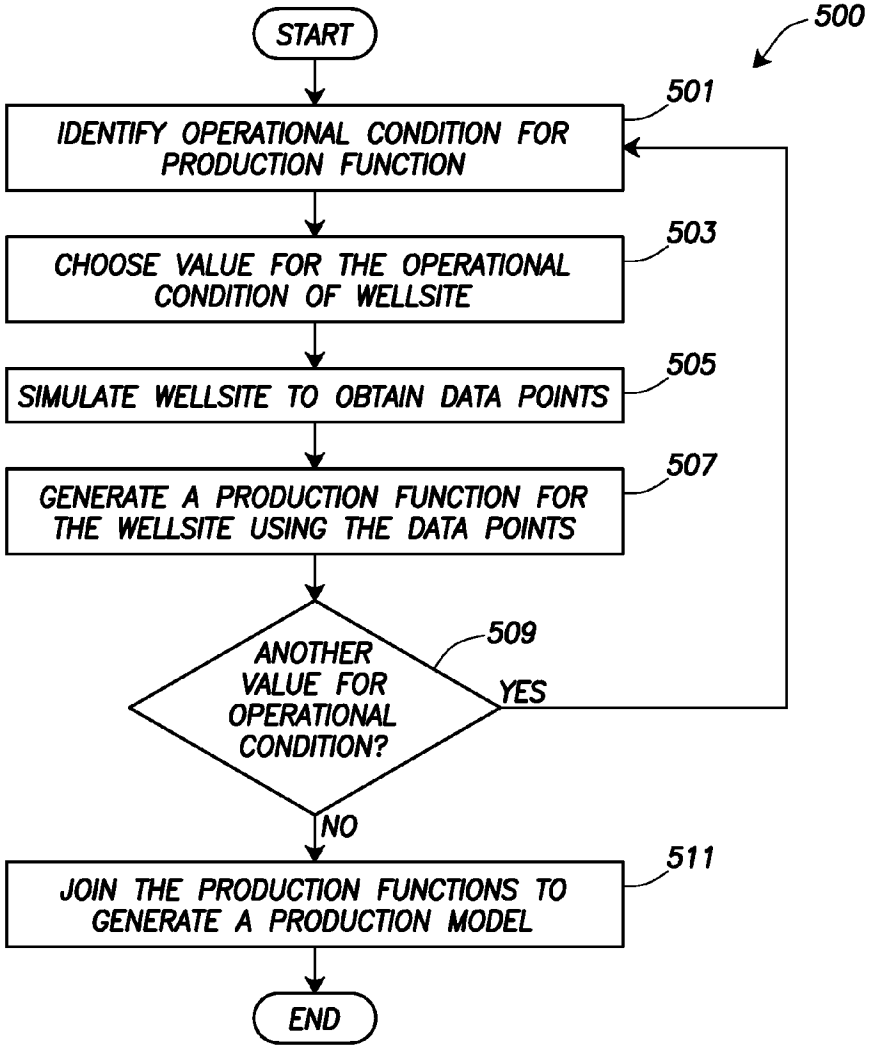
Figure 4:
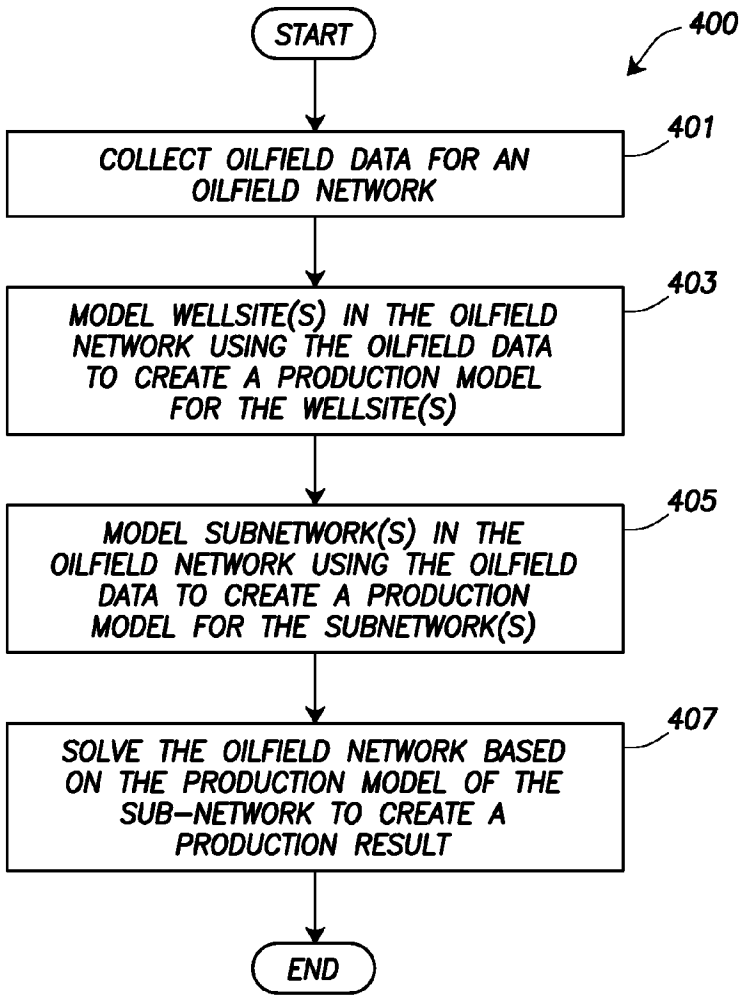

FIGS. 4-6 show example flowcharts depicting production methods for performing oilfield production operations. While the various actions in this flowchart are presented and described sequentially, one of ordinary skill will appreciate that some or all of the actions may be executed in different orders and some or all of the actions may be executed in parallel.

FIG. 4 shows a flowchart (400) depicting a production method. If the oilfield network exists, then, initially, sensor data may be collected from wellsites in the oilfield network. In 401, oilfield data is collected. The oilfield data may be collected from sensor data, from the oilfield network, and/or from a data source.

In 403, wellsite(s) in the oilfield network are modeled using the oilfield data to create a production model for the wellsite(s) (403). Modeling a wellsite may be performed, for example, as described in FIG. 5. The production models for each of the wellsites may be generated in parallel. Specifically, a production model may be generated for one wellsite of the oilfield network while a production model is generated for another wellsite of the oilfield network.

Continuing with FIG. 4, sub-network(s) in the oilfield network are modeled using the oilfield data to create a production model for the sub-network(s) (405). Modeling a wellsite may be performed, for example, as described in FIG. 6.

Based on the production model of the sub-network, the oilfield network is solved to create a production result (407). The production result may specify a flowrate (which may by the optimum flowrate to satisfy a particular production goal (e.g., number of barrels produced per day)) through the oilfield network. For example, the production result may specify a flowrate for each branch of the oilfield network.

Solving the oilfield network may be performed, for example, as discussed above using the Wegstein solver or the Newton solver. The Wegstein solver or the Newton solver may solve the oilfield network by treating each sub-network as a black box. Specifically, the properties of the sub-network are specified in the production models. More specifically, the production result may be calculated by performing the Wegstein solver or Newton solver using the production models of the sub-networks without analyzing the particular wellsites or branches in the sub-network that each black box represents. The result of the network solver may specify the flowrate for each of the sub-network black boxes and for the branches. The flowrate for each sub-network black box may be propagated to the wellsites in the sub-network using the production models.

The oilfield network may be planned using the production result. Planning the oilfield network may include performing the above actions for different configurations of the pipes in the oilfield network. For each configuration, a determination may be made about whether the flowrate achieves a desired flowrate given the cost of the configuration, (i.e., cost of pipes, labor to generate, labor and parts to maintain configuration, etc.). The configuration that generates the desired flowrate for the minimum cost may be the planned oilfield network. The planned oilfield network may be implemented by building the physical oilfield network according to the planned oilfield network. Once the oilfield network is built, the oilfield network may be configured such that each pipe has the flowrate specified by the production result. The oilfield network may then be monitored.

Rather than or in addition to planning the oilfield network, the flowrates of fluid and/or gas in an existing oilfield network may be adjusted. For example, by comparing the calculated flowrate for each of the branches with the actual flowrate of the pipe. If the calculated flowrate and the actual flowrate are not the same, then a determination may be made as to whether a faulty component exists in the oilfield network or whether the oilfield network needs to be reconfigured. A faulty component may be identified by comparing sensor data with the production models at each point in the oilfield network and/or by performing onsite inspection when required. Thus, a faulty component may be corrected by replacing or repairing the faulty component. The oilfield network may require reconfiguration when it is determined that the current configuration is not the configuration specified in the production result. An oilfield network may be reconfigured, for example, by adjusting production from or injection into specific wellsite(s). In another example, the oilfield network may be reconfigured, by adjusting an allowed flowrate of at least one wellsite. These allowed settings may be modeled in the production result to help constrain the oilfield network so that it will not exceed operational limits.

FIG. 5 shows a flowchart (500) depicting a method for generating a production model for a wellsite. The reservoir of the wellsite may have a known composition, known temperature, and a known pressure. Initially, an operational condition for the production function is identified (501). If an operational condition, such as the watercut, reservoir pressure, or gas lift rate, is unknown, then a user may request to have multiple production functions with each production function modeling a different potential value for the operational condition. Thus, a value for the operational condition is chosen (503). Choosing the value may be based on historical data or knowledge about the wellsite, actual data (e.g., sensor data), or a combination thereof.

The wellsite is simulated to obtain data points according to the operational condition (505). Simulating the wellsite may be performed by choosing a flowrate, and simulating the wellsite by assuming the flowrate from the reservoir to determine a final pressure and temperature for the flowrate at the surface. The final pressure and temperature creates a data point on the production function curve. Techniques for simulating the wellsite for a flowrate are well known in the art. The method of simulating the wellsite may be performed for additional flowrates to obtain additional data points. The maximum flowrate is the flowrate that results from zero pressure at the surface. The minimum flowrate is zero.

Using the data points, the production function is created for the wellsite (507). By performing the simulation for different flowrates (e.g., for thirty flowrates) a pressure-temperature-flowrate production function may be generated for the wellsite.

A determination may be made whether to include another value for the operational condition (509). If a determination is made for another value for the operational condition, then the operational condition for another production function is identified (501). Thus, another production function may be created for the new value using the steps described above.

Once the production functions are generated, the production model for the wellsite may be generated from the production functions (511). The production model may be the group of production functions.

FIG. 6 shows a flowchart (600) depicting a method for generating a production model for each of the sub-networks. As discussed below and in FIG. 6, one method for generating the production model is to combine production models defined for sub-networks of the sub-network. The production model allows for the sub-networks to be treated as black boxes. Specifically, when a production model is generated for a wellsite, the wellsite is treated as a black box. Similarly, production models may be combined into a single production model and subsequently treated as a black box defined by the single production model. Thus, the production model in FIG. 6 may be generated from other production models.

For each of the wellsites, the branch connected to the wellsite is identified (601). At this stage, the production model for the wellsite is set as the production model for the branch connected to the wellsite. Specifically, the production model for the branch is calculated based on the production model for the wellsite. For example, if the branch has hydrocarbons flowing from the wellsite, then the production model for the opposite end of the branch is calculated from the production model for the wellsite. Specifically, the production model of the wellsite is used in conjunction with the properties of the branch to determine the pressure, flowrate, and other such parameters when the fluid and/or gas flows out of the branch, such as at a junction of branches.

Branches that intersect and have a defined production model are grouped together (603). Branches that join at a junction to connect to a single branch are grouped when all branches that join at the junction have a production model, as calculated in 601. The branches further have the same direction of flow of fluid and/or gas. In particular, all branches that join at the junction either feed fluid and/or gas to the junction or receive fluid and/or gas from the junction. The grouped branches and the wellsites connected to the branch may be treated as a sub-network.

Thus, the production models for the group of branches that join into the single branch are combined (605). Generating a combined production model may be performed, for example, by choosing a pressure. For each of the branches meeting at the junction, the flowrate for the specified pressure is identified from the production model for the branch. Next, the flowrates of the branches are totaled to obtain the inlet flowrate at the specified pressure for the single branch that does not have a defined production model. A determination may be made about whether the inlet flowrate exceeds the maximum flowrate allowed. For example, the pipe represented by the branch may not be able to implement the flowrate because of factors, such as the diameter of the pipe, material, etc. If the inlet flowrate exceeds the maximum flowrate, the pressure may be considered invalid. However, if the inlet flowrate does not exceed the maximum flowrate, then the method may continue using the pressure. A similar process may be undertaken when the oilfield network is an injection network.

Further, the composition of fluid and/or gas may be identified by identifying the flowrate for each of the branches and combining the compositions according to the flowrate.

Once the inlet flowrate and composition into the single branch is known for a given pressure, the single branch may be modeled to generate an outlet flowrate and composition for the pressure. Modeling the single branch may be performed using techniques known in the art. The modeling may account for friction, elevation changes, heat transfer, and other such factors. The method for identifying the outlet flowrate for a given pressure may be repeated for additional pressures. Once the outlet flowrates for multiple pressures of the single branch are known, the combined production function is generated by identifying a best-fit line or curve of the pressure, flowrate points.

Multiple production functions may be generated for the different operational conditions specified in each branch's production model. Specifically, for each value of an operational condition that has a defined production function in each of the production models of the branches, a combined production function for the single branch may be generated according to the value of the operational condition. The production functions may be grouped into a production model for the single branch and subsequently for the sub-network.

Once the combined production model is generated, a determination is made about whether to combine additional branches (607). Specifically, a determination may be made whether 603 and 605 can be repeated for another group of branches. If a determination is made to group additional branches, then the branches are grouped (607). Alternatively, if additional branches are not to be grouped together, then the production models for the sub-networks are set (609). At this stage, the production models may be used to solve the oilfield network as discussed above and in FIG. 4.

Figure 7:
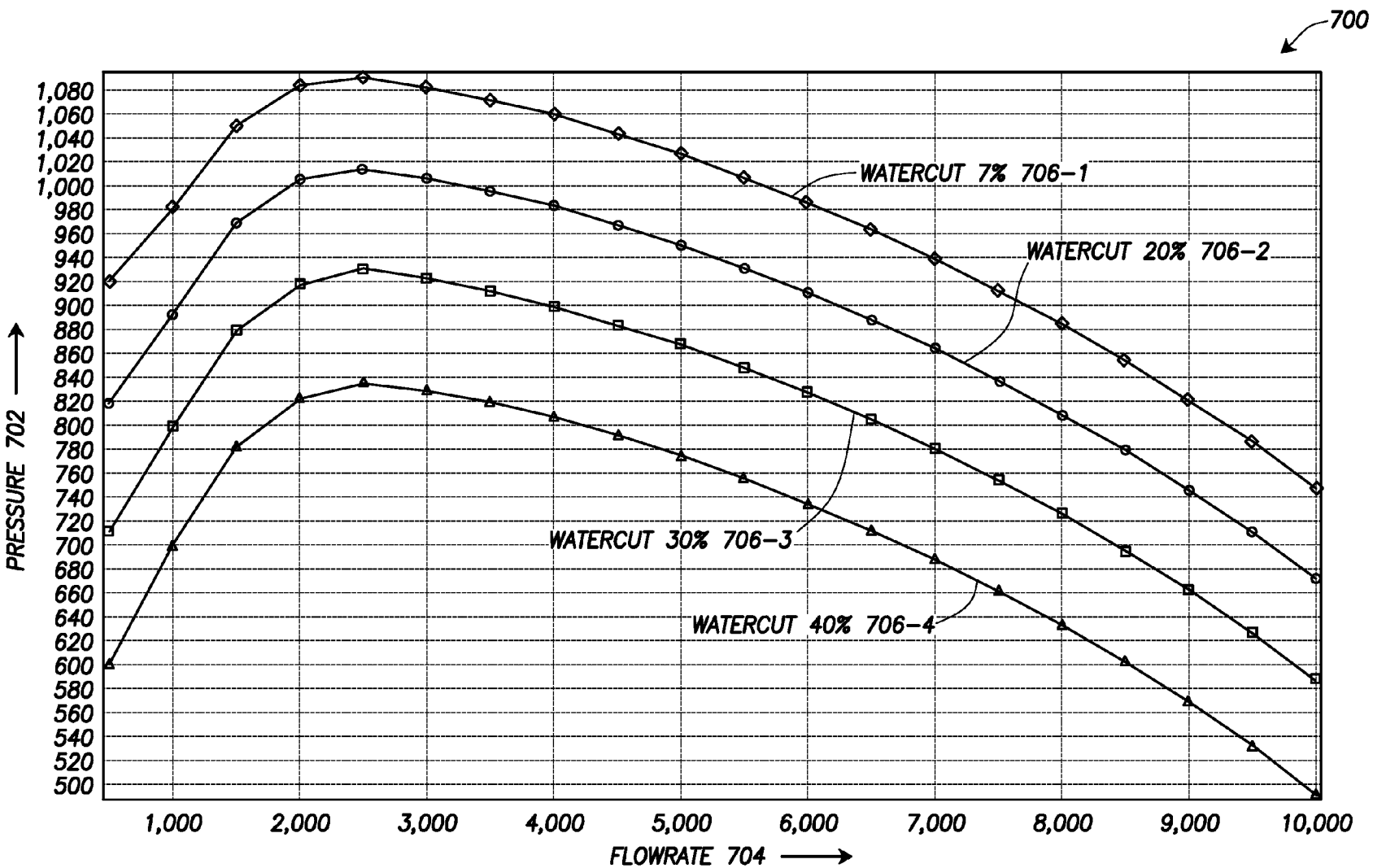

FIGS. 7-14 show examples of production methods for performing oilfield production operations. FIG. 7 shows an example of a production model (700). In the example, the production model (700) shows how different pressures relate to different flowrates at specified values for an operational condition. Specifically, the operational condition of the production model is the watercut. Thus, separate production functions (706-1, 706-2, 706-3, 706-4) are generated for different values of the watercut (i.e., 10% watercut, 20% watercut, 30% watercut, 40% watercut). Each of the production functions (706-1, 706-2, 706-3, 706-4) shows pressure (702) as a function of flowrate (704). For example, the production model (700) shows that a flowrate of 4,000 with a 10% watercut has a pressure of 1,060.

Figure 8:
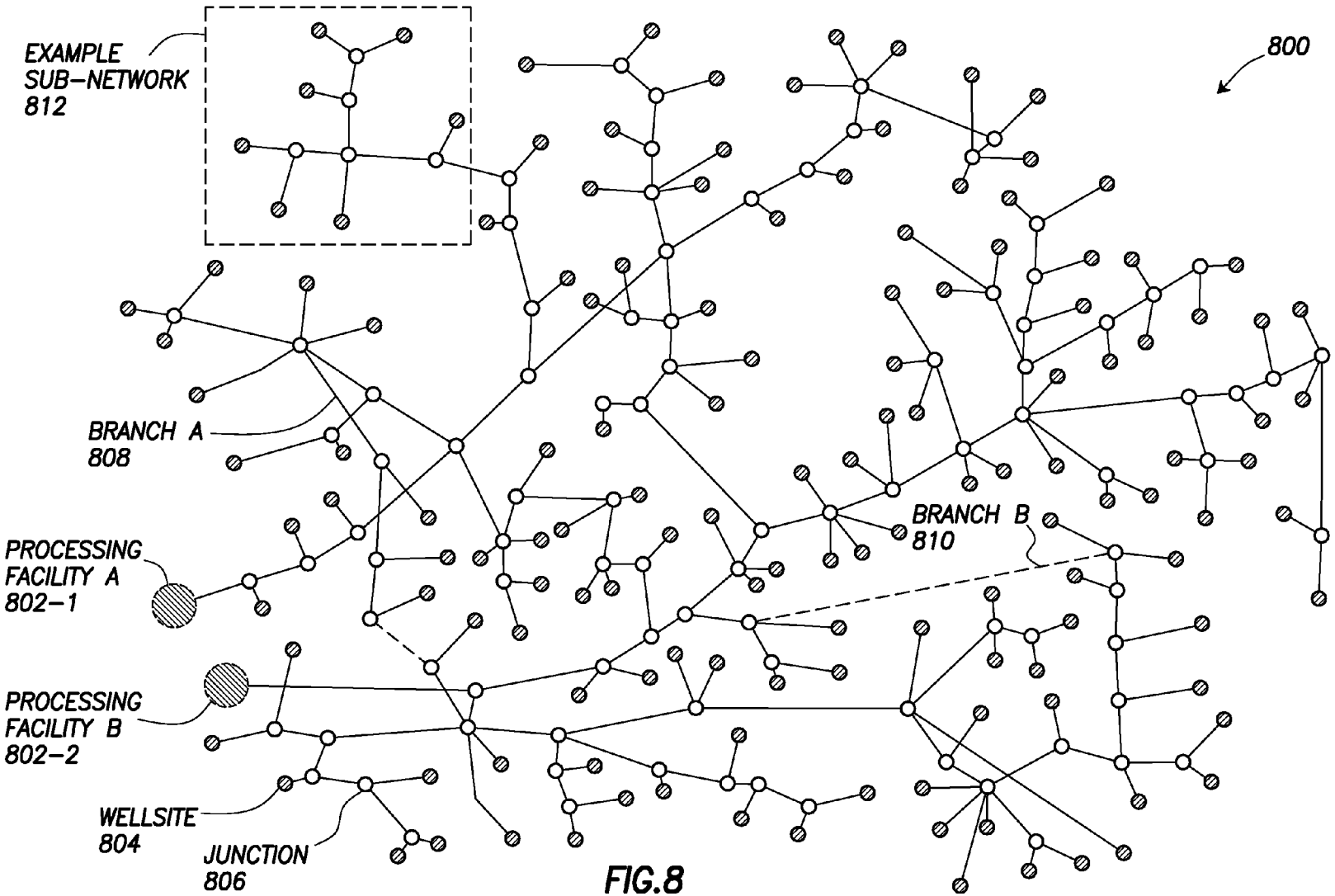

FIG. 8-14 show an example of generating and combining production models to generate a production result. FIG. 8 shows an example oilfield network (800). In the example oilfield network, two processing facilities (i.e., processing facility A (802-1), processing facility B (802-2)) collect hydrocarbons from wellsites (e.g., wellsite (804)). In FIG. 8, the wellsites (e.g., wellsite (804)) are denoted as solid black circles, the junctions (e.g., junction (806)) are denoted as white circles with a black border, and the branches or pipes (e.g., branch A (808)) are denoted as lines. A dotted line indicates that a branch (e.g., branch B (810)) does not permit flow of hydrocarbons or injection substances. For example, the branch may represent a pipe that is only used when required. When generating a production model, the branches (e.g., branch B (810)) that do not permit flow of hydrocarbons or injection substances are ignored.

Figure 9:
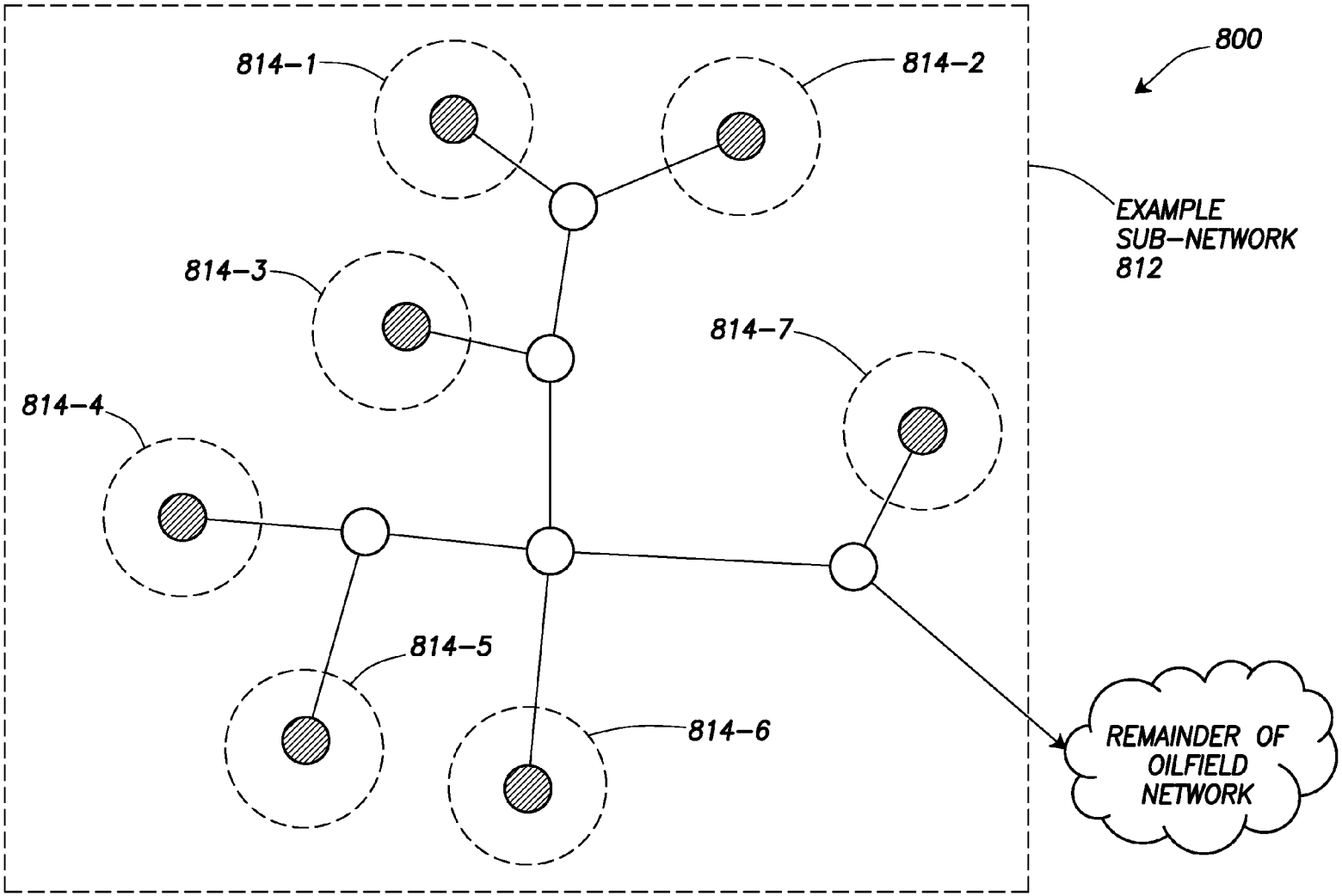

For example, the following is an example of generating a production model for the example sub-network (812). One skilled in the art will appreciate that a similar method may be used for generating a production model for the entire oilfield network (800). In the following example, circles with dotted borders indicate that a production model is defined for the sub-network inside of the circle. FIG. 9 shows a first iteration of generating a production model. As shown in FIG. 9, the production models for the wellsites (814-1-814-7) are initially defined. Defining the production models for the wellsites may be performed by modeling how the amount of pressure achieved is affected by the flowrates for the wellsite. One or more production curves may be generated while modeling the wellsite. Each wellsite may be treated as an individual sub-network.

Figure 10:
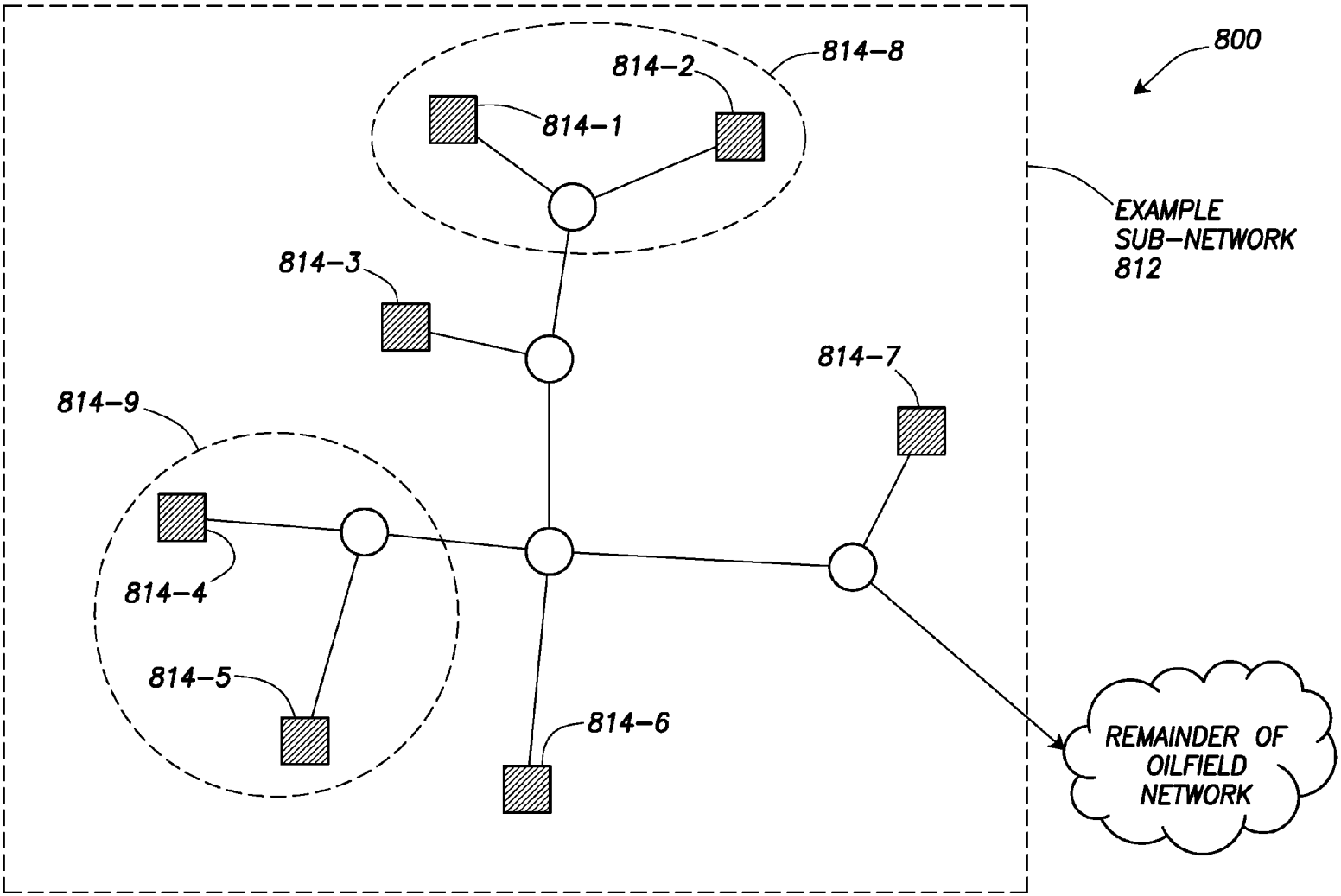

Next, as shown in FIG. 10, production models for sub-networks that join at a junction with only a single branch that has an undefined production model are combined. As shown in FIG. 10, after defining a production model for a wellsite, the wellsite may be treated as a black box. Thus, in FIG. 10, the production models (814-1, 814-2 in FIG. 9) are combined to create production model (814-8). Similarly, production models (814-4, 814-5 in FIG. 9) are combined to create production model (814-9). Combining the production model may be performed by determining for each pressure, the corresponding inlet flowrate for the single branch. Further, the composition is also determined. Once the inlet flowrate and composition is determined, the outlet flowrate is calculated. Thus, the combined production model for the sub-networks (814-8, 814-9) is generated.

Figure 11:
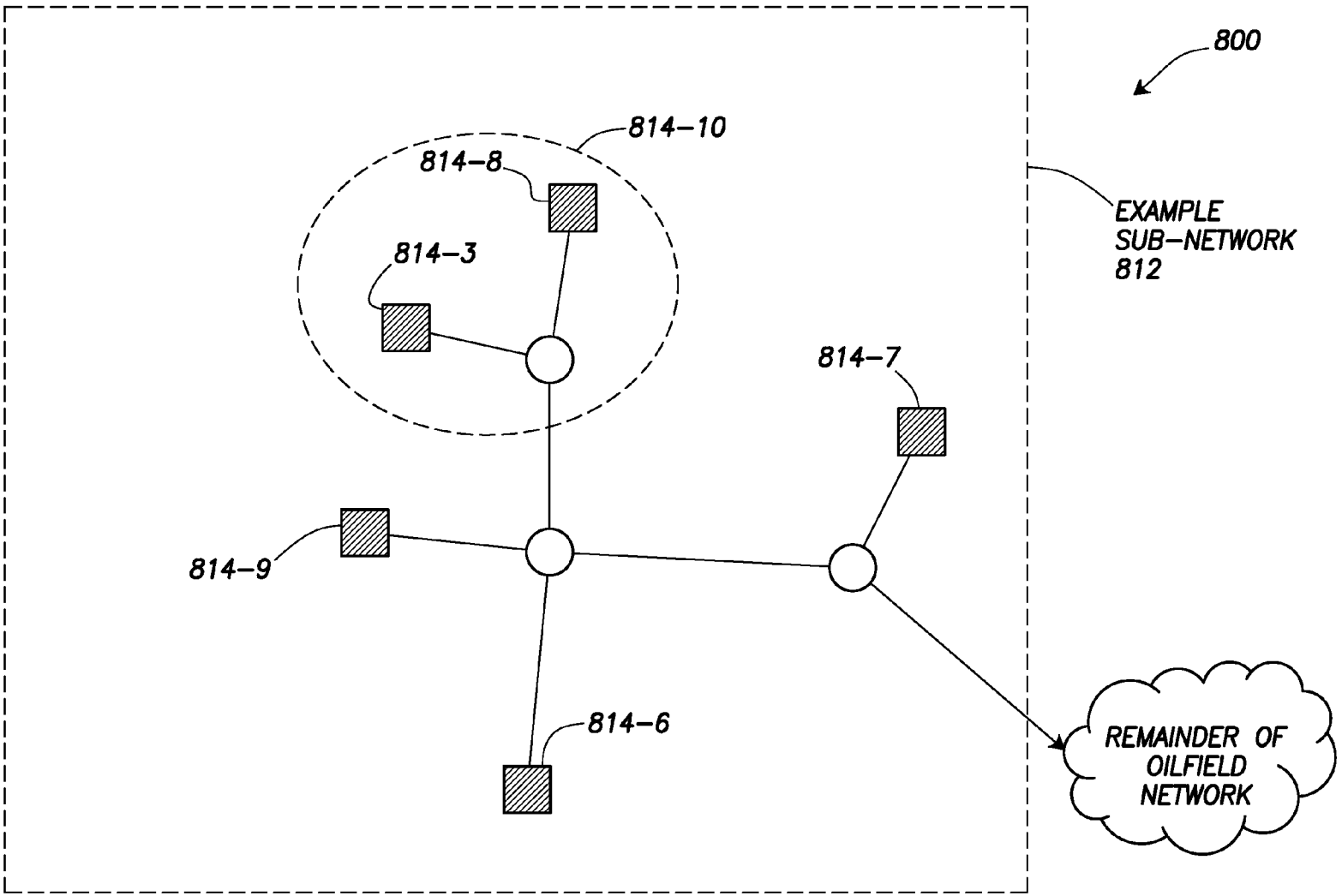
Figure 12:
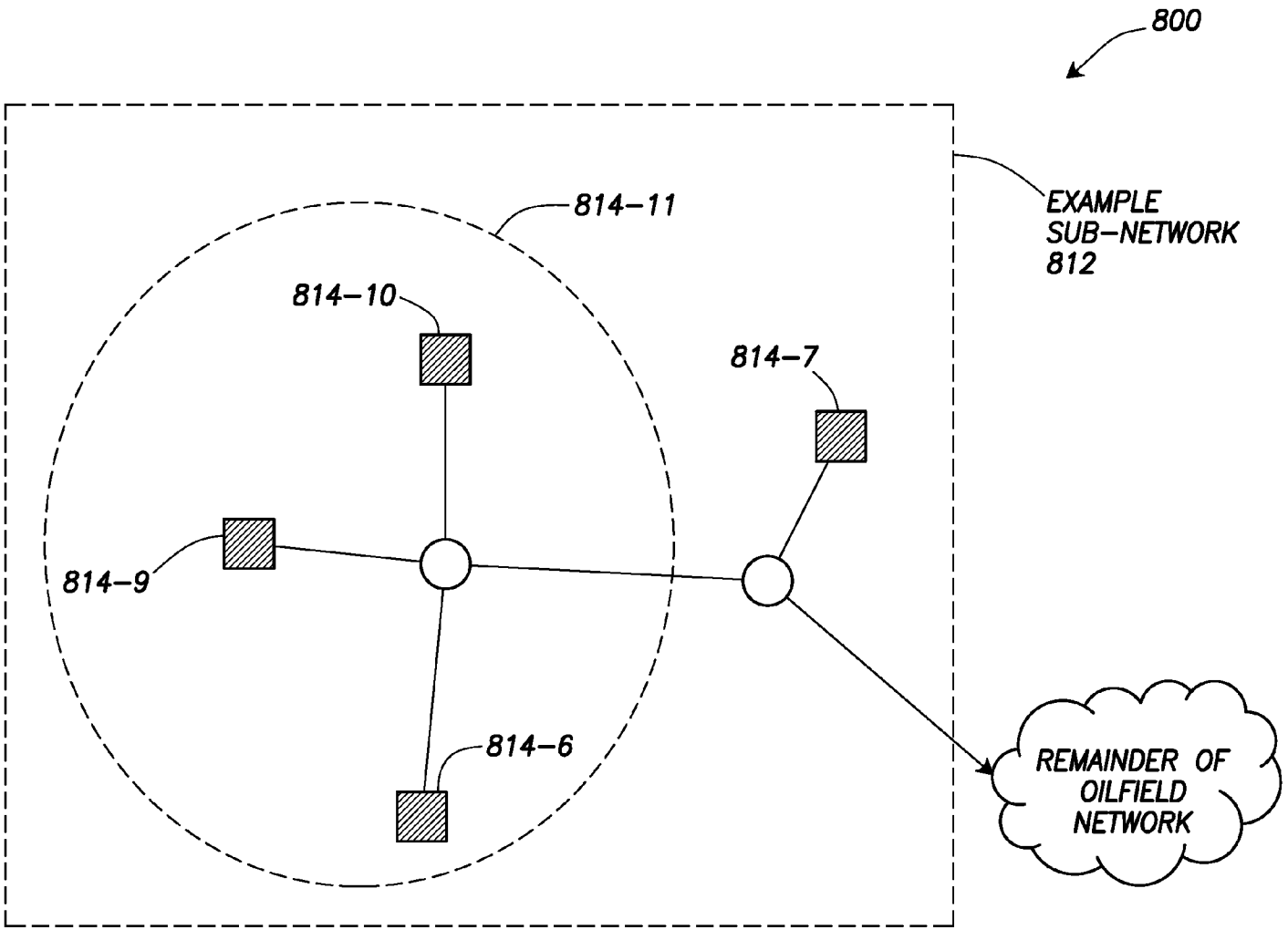
Figure 13:
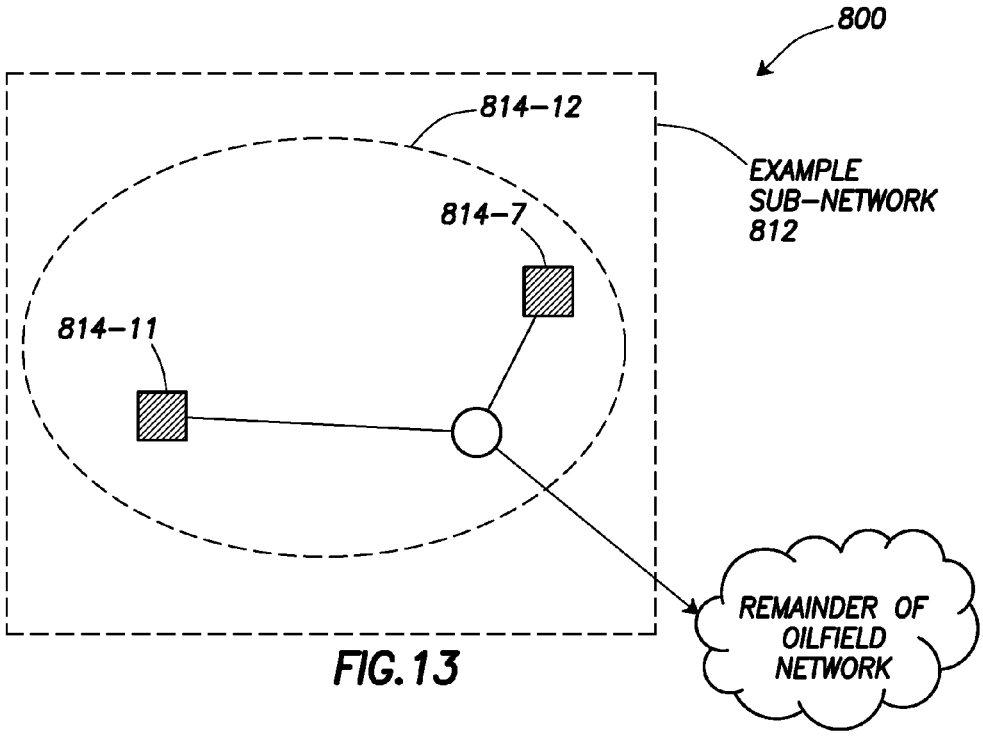

FIG. 11 shows how the process may repeat to combine the production models for sub-networks (814-3, 814-8) to generate combined production model (814-10). Once production model (814-10) is generated, a combined production model (814-11) may be generated by combining production models (814-10, 814-9, 814-6) as shown in FIG. 12. Finally, after generating production model (814-11), combined production model (814-12) may be generated by combining production models (814-11, 814-7) as shown in FIG. 13. Thus, as shown in FIG. 14, the production model (814-12) for the example sub-network (812) may be generated by iteratively combining production models for sub-networks of the sub-network.

Further, as shown in the example, with each combination, previously generated production models may be treated as black boxes. Specifically, once the production model for the sub-network is defined, the layout of wellsites in the sub-network, the specific flowrate of each wellsite, and the composition may be ignored when generating subsequent production models.

Figure 15:
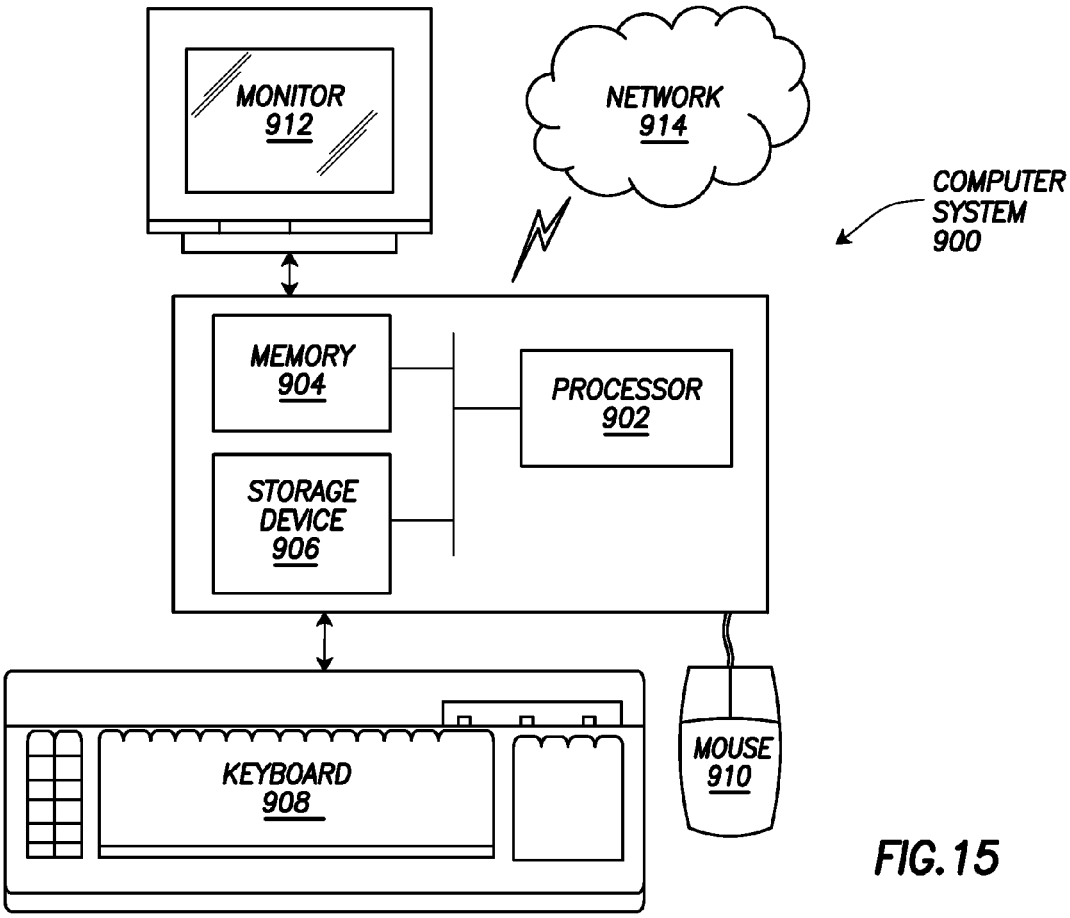
FIG. 15 shows an example computer system for analyzing an oilfield network for oilfield production.

Embodiments may be implemented on virtually any type of computer regardless of the platform being used. For example, as shown in FIG. 15, a computer system (900) includes one or more processor(s) (902), associated memory (904) (e.g., random access memory (RAM), cache memory, flash memory, etc.), a storage device (906) (e.g., a hard disk, an optical drive such as a compact disk drive or digital video disk (DVD) drive, a flash memory stick, etc.), and numerous other elements and functionalities typical of today's computers (not shown). The computer (900) may also include input means, such as a keyboard (908), a mouse (910), or a microphone (not shown). Further, the computer (900) may include output means, such as a monitor (912) (e.g., a liquid crystal display (LCD), a plasma display, or cathode ray tube (CRT) monitor). The computer system (900) may be connected to a network (914) (e.g., a local area network (LAN), a wide area network (WAN) such as the Internet, or any other type of network) via a network interface connection (not shown). Those skilled in the art will appreciate that many different types of computer systems exist, and the aforementioned input and output means may take other forms. Generally speaking, the computer system (900) includes at least the minimal processing, input, and/or output means necessary to practice embodiments of oilfield analysis.

Further, those skilled in the art will appreciate that one or more elements of the aforementioned computer system (900) may be located at a remote location and connected to the other elements over a network. Further, embodiments may be implemented on a distributed system having a plurality of nodes, where each portion may be located on a different node within the distributed system. In one embodiment, the node corresponds to a computer system. Alternatively, the node may correspond to a processor with associated physical memory. The node may alternatively correspond to a processor or micro-core of a processor with shared memory and/or resources. Further, software instructions to perform embodiments may be stored on a computer readable medium such as a compact disc (CD), a diskette, a tape, a file, or any other computer readable storage device.

It will be understood from the foregoing description that various modifications and changes may be made without departing from the scope of analyzing an oilfield network for oilfield production. For example, any of the methods described above may be performed in different sequences than those shown, with or without all of the discussed elements. Further, the components provided may be integrated or separate. Moreover, the methods described above can be performed using software, hardware, firmware, logic, or any combination thereof.

This description is intended for purposes of illustration only and should not be construed in a limiting sense. The scope should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A method for performing an analysis of an oilfield network comprising:

(a) collecting oilfield data from a plurality of wellsites in the oilfield network, wherein the oilfield network comprises one or more sub-networks;

(b) creating a production model of one of the sub-networks by:

(i) identifying a junction of a branch associated with one or more wellsites that are part of the one of the sub-networks;

(ii) generating one or more production models for the one or more wellsites using the oilfield data, wherein each production model is based on one or more operational conditions;

(iii) combining the production models and one or more properties of the branch to create a production model for the junction, wherein the production model of the one of the sub-networks is created using the production model for the junction;

(iv) repeating steps (i)-(iii) for each junction in the one of the sub-networks;

(c) repeating step (b) for each sub-network;

(d) solving the oilfield network based on the production model of each sub-network to create a production result; and (e) storing the production result.

2. The method of claim 1, wherein solving the oilfield network is performed using a Wegstein solver.

3. The method of claim 1, wherein solving the oilfield network is performed using a Newton solver.

4. The method of claim 1, wherein each production model is generated by:

generating one or more production functions for one or more values of the operational conditions; and joining the production functions.

5. The method of claim 1, further comprising:

using the production result in an oilfield application.

6. The method of claim 1, further comprising:

defining the oilfield network using the production result to obtain a defined oilfield network;

implementing the defined oilfield network to obtain an implemented oilfield network; and monitoring the implemented oilfield network.

7. The method of claim 1, wherein the operational conditions identify one or more properties of a hydrocarbon or an injection substance being produced at the wellsites.

8. The method of claim 1, wherein the operational conditions comprise a watercut, reservoir pressure, a gas lift rate or combinations thereof.

9. The method of claim 1, wherein the production model of the one of the sub-networks is created by combining the production model for each junction in the one of the sub-networks.

10. A system for oilfield network analysis comprising:

an oilfield transceiver for obtaining oilfield data for an oilfield;

an oilfield modeler executable by a processor for modeling a portion of the oilfield using the oilfield data;

an oilfield analyzer executable by the processor comprising:

an offline tool configured to create a first production model of the portion of the oilfield using a single branch solver, wherein the single branch solver is configured to create a second production model of at least one wellsite in the portion of the oilfield, and wherein the offline tool uses the second production model to create the first production model; and a network solver configured to solve the portion of the oilfield based on the first production model, thereby creating a production result; and a data repository to store the production result.

11. The system of claim 10, wherein the network solver comprises a Wegstein solver for solving the oilfield network.

12. The system of claim 10, wherein the network solver comprises a Newton solver for solving the oilfield network.

13. The system of claim 10, wherein the oilfield analyzer further comprises at least one selected from a group consisting of a fluid modeler, a flow modeler, and an equipment modeler.

14. The system of claim 10, wherein the oilfield modeler comprises at least one selected from a group consisting of a wellbore modeler and a network modeler.

15. The system of claim 10, wherein the oilfield analyzer further comprises a production analyzer.

16. The system of claim 10, further comprising a report generator configured to generate a report of the production result.

17. A non-transitory computer readable medium comprising computer readable program code embodied therein for causing a computer system to:

collect oilfield data for an oilfield network comprising a plurality of wellsites;

create a first production model of a first wellsite in the plurality of wellsites using the oilfield data by:

generating a production function for a first value of an operational condition;

generating a production function for a second value of the operational condition; and joining the production function for first value with the production function for the second value into the first production model;

create a second production model of a sub-network of the oilfield network using the first production model; and solve the oilfield network based on the second production model, thereby creating a production result; and display the production result.

18. The non-transitory computer readable medium of claim 17, wherein the computer readable program code further causes the computer system to:

create a third production model of a second wellsite in the plurality of wellsites using the oilfield data by:

identifying a junction of a branch associated with the first wellsite and a branch associated with the second wellsite; and combining the first production model with the third production model to create a fourth production model for the junction, wherein the second production model is created using the fourth production model.

19. The non-transitory computer readable medium of claim 17, wherein the computer readable program code further causes the computer system to:

define the oilfield network using the production result to obtain a defined oilfield network, wherein the defined oilfield network is implemented the defined oilfield network to obtain an implemented oilfield network; and monitor the implemented oilfield network.

20. The non-transitory computer readable medium of claim 17, wherein solving the oilfield network is performed using at least one selected from a group consisting of a Wegstein solver and a Newton solver.

* * * * *